US007745730B2

(12) United States Patent
Bailey

(10) Patent No.: US 7,745,730 B2
(45) Date of Patent: Jun. 29, 2010

(54) WIRING COMPONENT

(75) Inventor: John Michael Bailey, Hingham (GB)

(73) Assignee: Beru F1 Systems Limited, Diss (GB)

( * ) Notice: Subject to any disclaimer, the term of this patent is extended or adjusted under 35 U.S.C. 154(b) by 435 days.

(21) Appl. No.: 11/752,836

(22) Filed: May 23, 2007

(65) Prior Publication Data

US 2007/0235209 A1 Oct. 11, 2007

Related U.S. Application Data

(63) Continuation of application No. PCT/GB2007/000126, filed on Jan. 4, 2007.

(30) Foreign Application Priority Data

Jan. 17, 2006 (GB) ..... 0600878.3

(51) Int. Cl.
*H01B 7/08* (2006.01)

(52) U.S. Cl. ..... 174/117 F

(58) Field of Classification Search ..... 174/117 F, 174/117 A, 74 R
See application file for complete search history.

(56) References Cited

U.S. PATENT DOCUMENTS

| | | | | |
|---|---|---|---|---|
| 2,963,538 | A | 12/1960 | Dahlgren | |
| 3,086,071 | A | 4/1963 | Preston | |
| 3,168,617 | A | 2/1965 | Richter | |
| 5,371,324 | A | 12/1994 | Kanno et al. | |
| 6,419,289 | B1 | 7/2002 | Batten et al. | |
| 6,707,006 | B1 | 3/2004 | Myers | |
| 6,971,650 | B2 | 12/2005 | Marelja | |
| 2002/0046870 | A1* | 4/2002 | Zein et al. | 174/117 F |
| 2002/0170740 | A1* | 11/2002 | Yamanobe et al. | 174/117 F |
| 2003/0029628 | A1* | 2/2003 | Uttinger et al. | 174/106 R |
| 2004/0069525 | A1 | 4/2004 | Reibel et al. | |
| 2006/0060690 | A1 | 3/2006 | Aisenbrey | |
| 2006/0090924 | A1 | 5/2006 | Reibel et al. | |

FOREIGN PATENT DOCUMENTS

| | | | |
|---|---|---|---|
| DE | 35 24 516 | A1 | 1/1987 |
| DE | 299 17 502 | U1 | 2/2000 |
| DE | 103 08 759 | A1 | 9/2004 |
| EP | 0 208 138 | A1 | 1/1987 |
| EP | 0 376 131 | A3 | 7/1990 |
| EP | 1 026 019 | A2 | 8/2000 |
| EP | 1 376 618 | A2 | 1/2004 |
| FR | 1 443 943 | | 3/1965 |
| GB | 1 104 098 | | 2/1968 |
| GB | 1 226 203 | | 3/1971 |
| GB | 1 287 639 | | 9/1972 |
| GB | 2 227 356 | A | 7/1990 |
| JP | 1-183004 | | 7/1989 |
| JP | 9-306261 | | 11/1997 |

(Continued)

*Primary Examiner*—Chau N Nguyen
(74) *Attorney, Agent, or Firm*—Workman Nydegger

(57) ABSTRACT

A wiring component includes an array of multiple wires, at least one connector which engages the wires, and at least two layers of a hardened fiber and a filler compound that sandwiches the wires. The areas adjacent to the wires include a filler which immobilizes the wires relative to the layers. In one embodiment at least a portion of the connector is embedded in the filler.

29 Claims, 7 Drawing Sheets

FOREIGN PATENT DOCUMENTS

| | | | |
|---|---|---|---|
| JP | 2001-43743 | | 2/2001 |
| NL | 1012154 | | 2/2001 |
| WO | WO 99-11492 | | 3/1999 |
| WO | WO 01/98112 | A1 | 12/2001 |
| WO | WO 03/090971 | A1 | 11/2003 |
| WO | WO 03/098642 | A1 | 11/2003 |

* cited by examiner

WIRING COMPONENT

CROSS-REFERENCE TO RELATED APPLICATIONS

This application is a continuation of International Application No. PCT/GB2007/000126, filed Jan. 4, 2007, which claims priority to Great Britain Application Serial No. 0600878.3, filed Jan. 17, 2006, which are incorporated herein by specific reference.

BACKGROUND OF THE INVENTION

1. The Field of the Invention

The invention relates to wiring and in particular but not exclusively to in-vehicle wiring. The kind of vehicle envisaged may be selected from a wide range of vehicles from military vehicles such as tanks, to sport motors, rail, ice, air, water, and snow going vehicles.

2. The Relevant Technology

One prior art known is a flat carbon fiber case or box housing multiple wires such as those currently used in Formula One racing. In order to manufacture these boxes, the box is initially formed by molding carbon fiber faces of the box and joining them together and thereafter loosely placing the wires in their required position dependent upon the manufacturing specification. A drop of silicon or other sealant is then used to secure the lid of the box in place once the wires are installed within the box.

The following drawbacks exist in this prior art structure:

- the wires can displace within the box due to vibration, impact, explosions or other outside occurrence;
- these boxes which are essentially rectangular parallelepipeds are neither able to snugly fit around nor able to be placed on objects other than objects which are themselves flat;
- there are spaces between wires and between the faces of the box signifying that the strength of the box itself is reduced as each face if acted upon can separately bow;
- it requires the use of silicon or other sealants to secure the components together; and
- air fills any remaining space in the box which may cause corrosion within the box if corrosive components are contained in the box.

The following patent documents are acknowledged U.S. Pat. No. 6,971,650; DE10308759A1; EP1506553; US2006/000924; US2004/0069525; EP1376618A3; PCT/EP03/01531; WO03/098642; U.S. Pat. No. 6,419,289; DE29917502; EP1026019; U.S. Pat. No. 5,371,324; DE354516; EP0208138; and U.S. Pat. No. 3,168,617.

SUMMARY OF THE INVENTION

In a first broad independent aspect, the invention provides an array of multiple wires; one or more connectors which engage said wires; two or more layers of a hardened fiber and filler compound sandwiching said wires; the areas adjacent to the wires comprise a filler which immobilizes the wires relative to said layers; wherein at least a portion of said connectors is embedded in a filler.

This configuration is particularly advantageous because it allows the connector portions to be protected at their rear and ready for use at their front. This allows them to be an integral part of the connector and wires assembly. It also may be readily formed into a generally flat structure between the connectors in order to fit in confined spaces.

In a second broad independent aspect, the invention provides a wiring component comprising an array of multiple wires sandwiched between two or more layers of a hardened fiber and resin compound where the areas adjacent to the wires are filled by filler such as the resin or the resin and fiber compounds which immobilizes the wires relative to said layers; wherein the fibers are woven.

This configuration is particularly advantageous because it provides a particularly rigid structure and marks a complete departure from prior art non-woven teaching which results in components which are inherently flexible.

In a third broad independent aspect, a wiring component comprises an array of multiple wires sandwiched between two or more layers of a hardened fiber and resin compound where the areas adjacent to the wires are filled by a filler such as the resin or the resin and fiber compounds which immobilizes the wires relative to said layers; wherein the wires comprise copper and are sheathed with one or more sheaths which create a bond between the wires and layers.

This configuration is particularly advantageous because the sheaths themselves can contribute to the bonding of the wires with the layers.

In a fourth broad independent aspect, the invention provides a wiring component comprising an array of multiple wires sandwiched between two or more layers of a hardened fiber and resin compound where the areas adjacent to the wires are filled by a filler such as the resin or the resin and fiber compounds which immobilizes the wires relative to said layers; wherein the component incorporates a substantially planar portion and a lip extending from said planar portion at an angle. This configuration is particularly advantageous because it adds rigidity to the component and allows it to fit over a three dimensional object such as an engine.

In a subsidiary aspect in accordance with the invention, the connector incorporates a cap protecting its connectable portion; wherein said cap incorporates a seal on the inside of said cap. This configuration is particularly advantageous because it prevents the connector being damaged by filler flowing into the connectable portion.

In a further subsidiary aspect, the fibers are woven. This allows the layers to be strengthened.

In a further subsidiary aspect, the wires comprise copper and are sheathed in one or more sheaths which create a bond between the wires and layers.

In a further subsidiary aspect, the component incorporates a substantially planar portion and a lip extending from said planar portion at an angle.

In a fifth broad independent aspect, the invention provides an array of multiple wires sandwiched between two or more layers of a hardened fiber and resin compound where the areas adjacent to the wires are filled by the resin or the resin and fiber compounds which immobilizes the wires relative to said layers.

This configuration is particularly advantageous because it achieves an air free or almost air free protective box. It also provides all the advantages of a conventional carbon fiber box in that it is a solid structure with the toughness and the heat resistance of the traditional boxes. The array can be molded in a form to fit the shape of the body of a vehicle. This would therefore have the additional benefit of reducing the overall size requirement around an engine which can lead to a reduced size of body with less wind resistance than would otherwise be the case. It avoids any displacement of the wires relative to each other during use and installation of the wires within a receiving system. This configuration does away with the requirement for using silicon or other sealants and will therefore simplify the manufacturing process. This system may be used in a wide variety of applications which may include for example substituting traditional circular in cross-section sheathed heat resistant engine to chassis electrical multiple wire cables.

In a further subsidiary aspect in accordance with the invention's fifth broad independent aspect, the wires are substantially co-planar when viewed in a cross-section across the width of the wires. This marks a complete departure from the prior art teaching in circular cross-section cables. It would allow flat and curved wire arrays to be achieved which would provide the wire arrays with greater flexibility in terms of use whilst retaining the advantages of toughness and heat resistance associated with the prior art devices.

In a further subsidiary aspect, the compound is a non-conductive compound. This may for example be a compound of a material similar or identical to the material sold under the brand or designation "Kevlar" which would permit either the wires to be provided without any protective sheaths, if desired, or in the case of the melting of wire sheath of still retaining electrical insulation of the wires thus avoiding short circuits or other potentially dangerous consequences.

In a further subsidiary aspect, the two or more layers of compound are employed on either side of the multiple wires. The use of multiple layers allows a flat smooth surface to be produced rather than one which follows precisely the contour of the enclosed wires and would therefore be uneven above the wires. This optional configuration would therefore allow the wires to be disguised within the layers. It also reduces the stress/strain concentration points which would be located at these uneven regions of the surfaces when only one layer is used on both sides of the wires. It therefore offers a tougher and therefore more durable configuration than would otherwise be achieved.

In a further subsidiary aspect, the wires are sheathed in addition to said compound by a sheath which is resistant to 100 degrees in a vacuum oven. This particular kind of sheathing allows the wires to remain protected, immobilized and conductive only across the wires (i.e., without any risk of a short circuit in normal operation).

In a further subsidiary aspect, the array is rigid and molded to conform to the shape of a vehicle component. This particularly allows when the vehicle component is the vehicle body to save space within the vehicle body so that a vehicle body of a small size may be used which would have important benefits from a wind resistance point of view.

In a sixth broad independent aspect, the invention provides a method of producing an array of multiple wires, comprising the steps of:

selecting a plurality of wires placing them between layers of a hardenable fiber and resin compound;

vacuuming air from the array; and heat treating the array in a vacuum oven.

When this method is employed there is no complex post-hardening assembly required. The air is effectively removed from interstitial positions between the wires. Any given shape may be obtained by preferably placing the wires and the compound in a mold. This would allow compliance with any selected object for attachment. The product resulting from this method incorporates any of the advantages listed above with reference to previous specific aspects.

In a seventh broad independent aspect, the invention provides a method of producing a wire component, comprising steps of:

selecting a plurality of wires placing them between layers of a hardenable fiber and resin compound;

vacuuming air from the array;

placing the layers and wires on a mold; and heat treating the array in a vacuum oven.

In a subsidiary aspect in accordance with the invention's seventh broad aspect, the invention provides the step of attaching a connector to said wires and clamping said connector to said mold.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
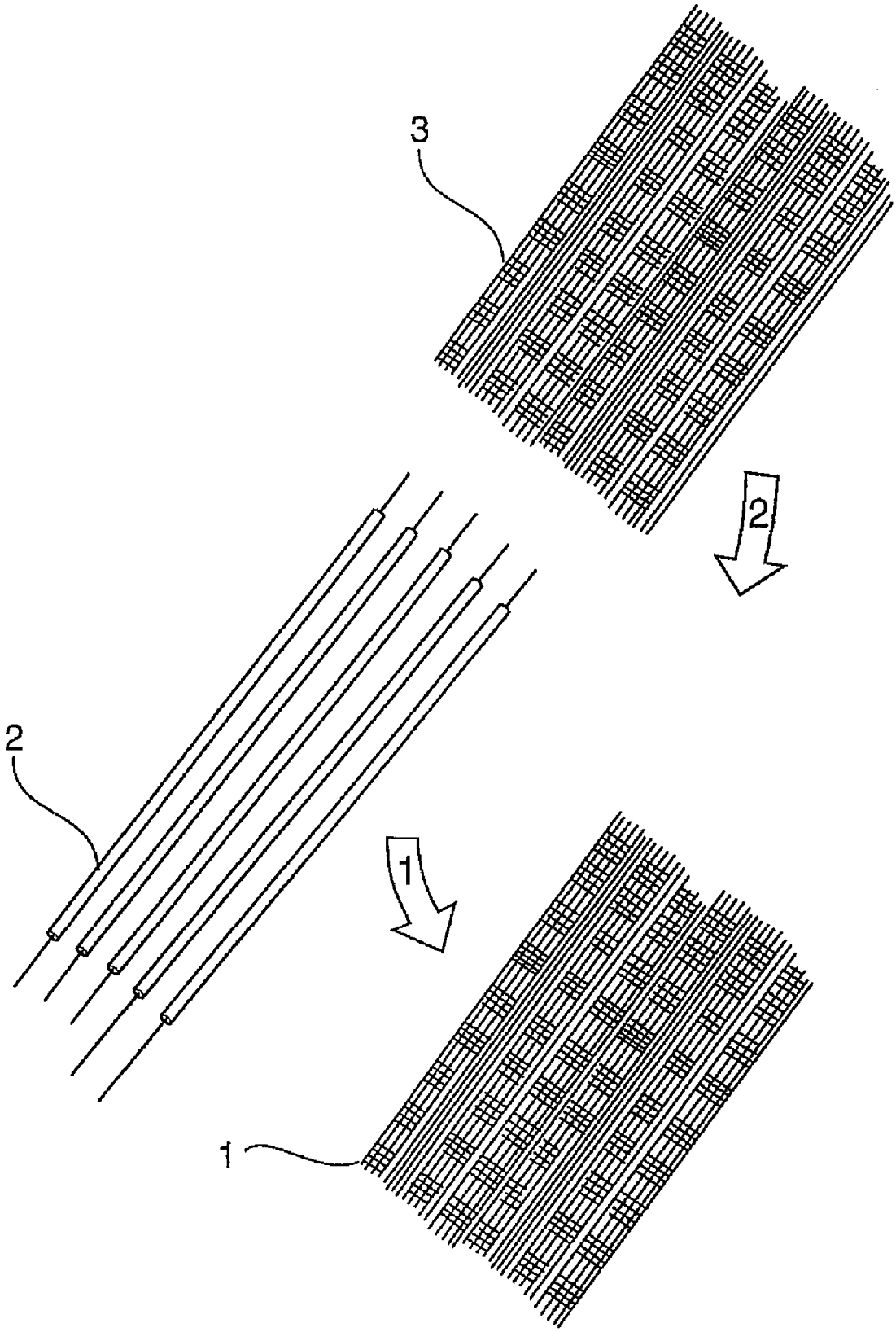
FIG. 1 schematically shows the assembly prior to heat treating.

FIG. 1 shows a lower layer 1 of fiber and resin compound prior to any heat treatment. The fiber and resin compound is formed as a sheet of interwoven fibers with the strands either extending in one direction or in a direction perpendicular to this direction. A cross-mesh is employed. These resin and fiber compounds are readily available in many formats. This particular resin and fiber compound may be a carbon fiber and resin compound. The natural stickiness of the resin allows the wires such as wire 2 to be placed in any appropriate configuration on the first layer. The second layer 3 may be placed on top of the array of wires and secured thereto.

The two layers and the wires may be placed on or in a mold which imposes its shape on the component. In order to improve the smoothness of the surface finish a glass or aluminum mold is preferred. An aluminum mold with a surface with a curve will allow the laminate to adopt the shape of that curve following the heat treatment. A station is provided for extraction of the air by vacuum between the layers prior to their placement in an autoclave oven for pressurized (preferably in a vacuum) heat treatment.

The temperature of the heat treatment is selected in order to strike a good balance between economy and rapidity of heat treatment. For this application however a treatment of approximately 100 to 125 degrees is preferred. After cooling of the component, the array of multiple wires becomes a solid structure with the geometry set by the mold.

The rigid structure can then be fitted with electrical connectors for incorporation into a vehicle as appropriate. It is also preferred during the heat treatment to continue to remove air from the component in order to minimize any risk of air bubbles in the interstitial regions between the wires.

Figure 2:
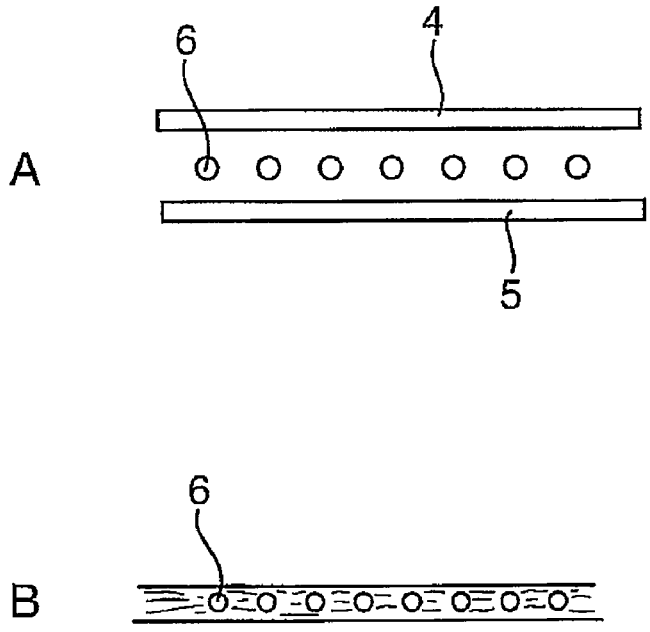
FIGS. 2*a* and 2*b* show cross sectional views of an array of multiple wires with one layer on both sides of the wires.

FIG. 2*a* shows a first layer 4 and a second layer 5 of fiber and resin compound and a number of wires such as wire 6 located between the layers. The wires may be sheathed or unsheathed as appropriate. This arrangement allows the wires to be substantially co-planar when viewed in cross-section across the width of the wires.

FIG. 2*b* shows wire 6 following the heat treatment. The spaces between the wires have now been occupied by resin primarily and potentially fibrous compound which therefore serve to immobilize the wires relative to the layers. Essentially no air is present between the wires. If necessary, prior to the heat treatment additional resin may be spread onto the layers to ensure that the filling between the wires occurs and to create a smoother finished outer surface.

Figure 3:
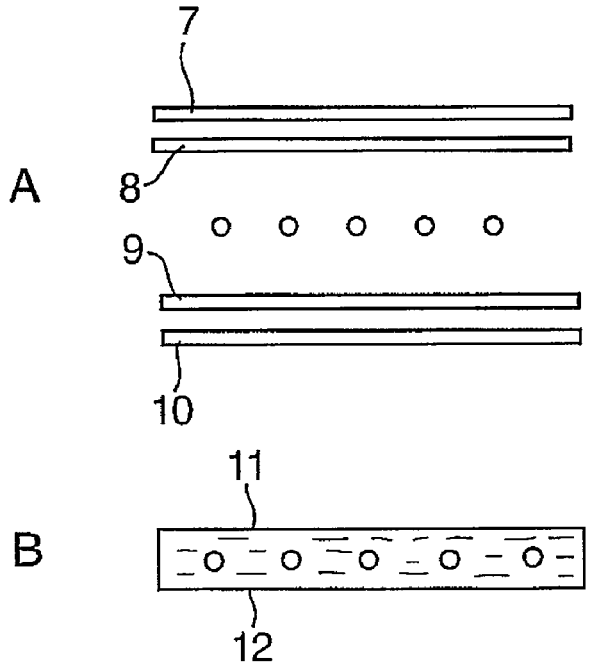
FIGS. 3*a* and *b* show cross sectional views of the array of multiple wires with two layers on both sides of the wires before and after treatment.

FIG. 3*a* shows the use of two layers on both sides of the wires. These are referenced 7, 8, 9 and 10 respectively.

Following heat treatment the interstitial regions between the wires have been substantially filled and the upper and lower surfaces 11 and 12 are smooth to mirror the smoothness of the aluminum mold or glass mold (two sheets of glass) which may be used to form a component during its preparation and hardening process. The mold may be a single sided mold.

Figure 4:
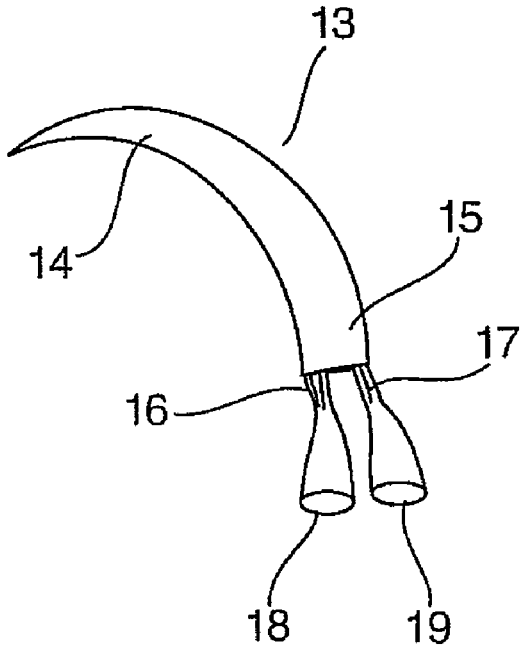
FIG. 4 shows in perspective view an end portion of an arc-shaped band of multiple wires where the band itself is rigid.

FIG. 4 shows an arc-shaped component 13 comprising an array of multiple wires sandwiched between two layers of hardened fiber and resin compound. The array of multiple wires is referenced 14. At one end 15 of the array of multiple wires, two sets 16 and 17 of wires protrude each joining their own individual connector 18 and 19. The connector illustrates is a standard circular connector. The arc-shaped region has a height of far lesser importance than the diameter of either of these connectors. This allows standard electrical connection to occur from a narrow flat space in a motor vehicle.

The invention also envisages the use of non-conductive compounds in the layers so that if the sheath of the wires are damaged or melt no short circuit would normally occur. It may also allow no sheath at all to be employed. Layers of Kevlar (brand name or known designation) are for example envisaged.

The invention also envisages that a layer forms an electrical screen similar to the braiding on electrical cables.

Furthermore, the wires may have two or more different diameters. The resin and fiber compounds are selected to be able to advantageously conform with a range of wires of different diameters.

Figure 5:
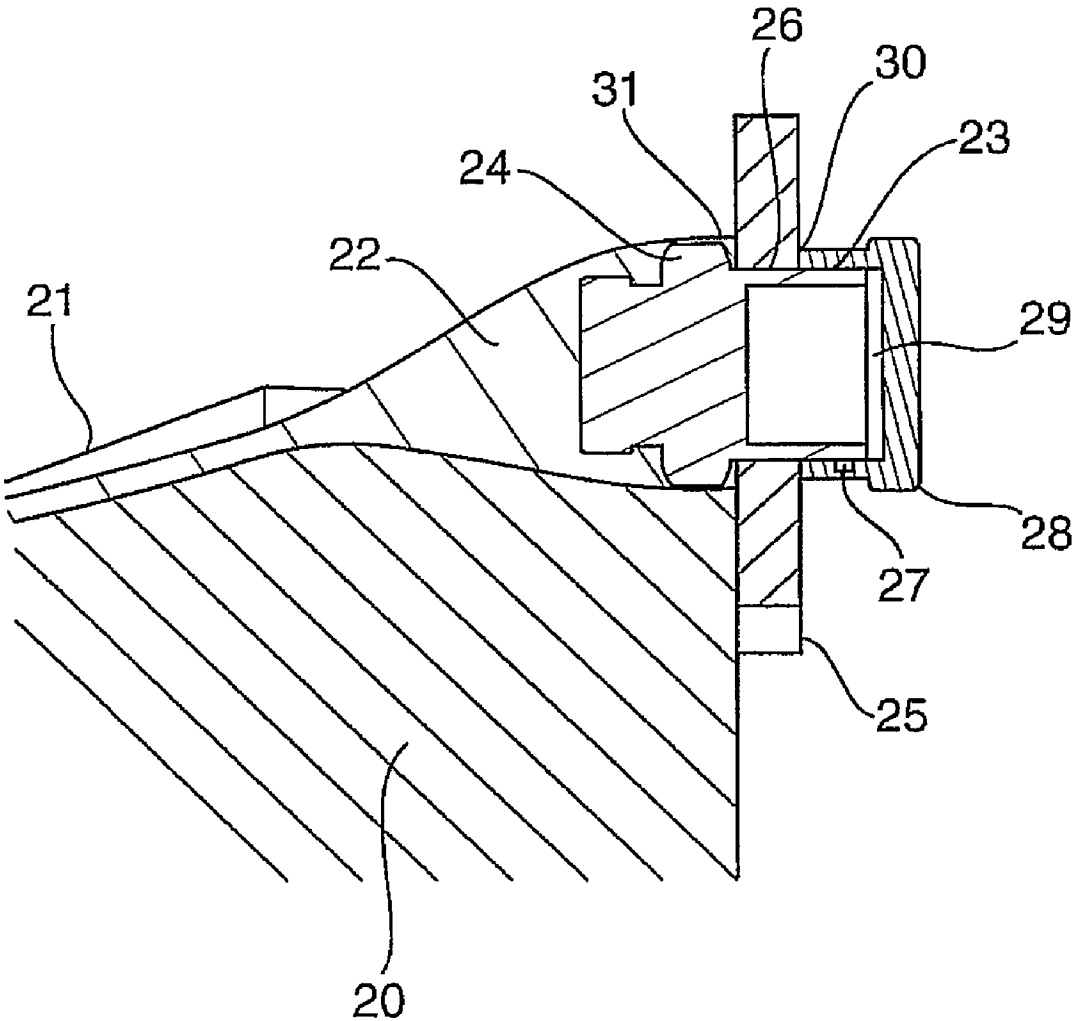
FIG. 5 shows a cross sectional view of a wiring component located in a mold.

FIG. 5 shows a mold 20 on which is placed a wiring component generally referenced 21 which comprises an array of copper wires located between two layers of hardened fiber and filler compound. Under the vacuum conditions of production, wires and filler paste 22 fill the rear portion of a connector 23. The connector incorporates a flange 24 which abuts against a connector location plate 25. The connector location plate 25 incorporates a diameter 26 with a number of indents in order to allow the passage of connector projections 27. The connector location plate acts as a barrier when it is tightly attached to the mold 20 in order to tend to prevent filler covering the entire connector. For the same effect, there is also provided a connector protective cap 28 which fits tightly over the connectable portion of the connector. A rubber seal 29 is located on the inside of the cap and as the cap is secured to the connector it keeps any filler from entering the connector portions which necessarily are to be kept free of filler for correct electrical connection. Corner 30 is preferably also filled with temporary masking compound to create an extra seal. As can be seen from the figure at arrow 31 the composite material surrounds the rear portion of the connector.

Figure 6:
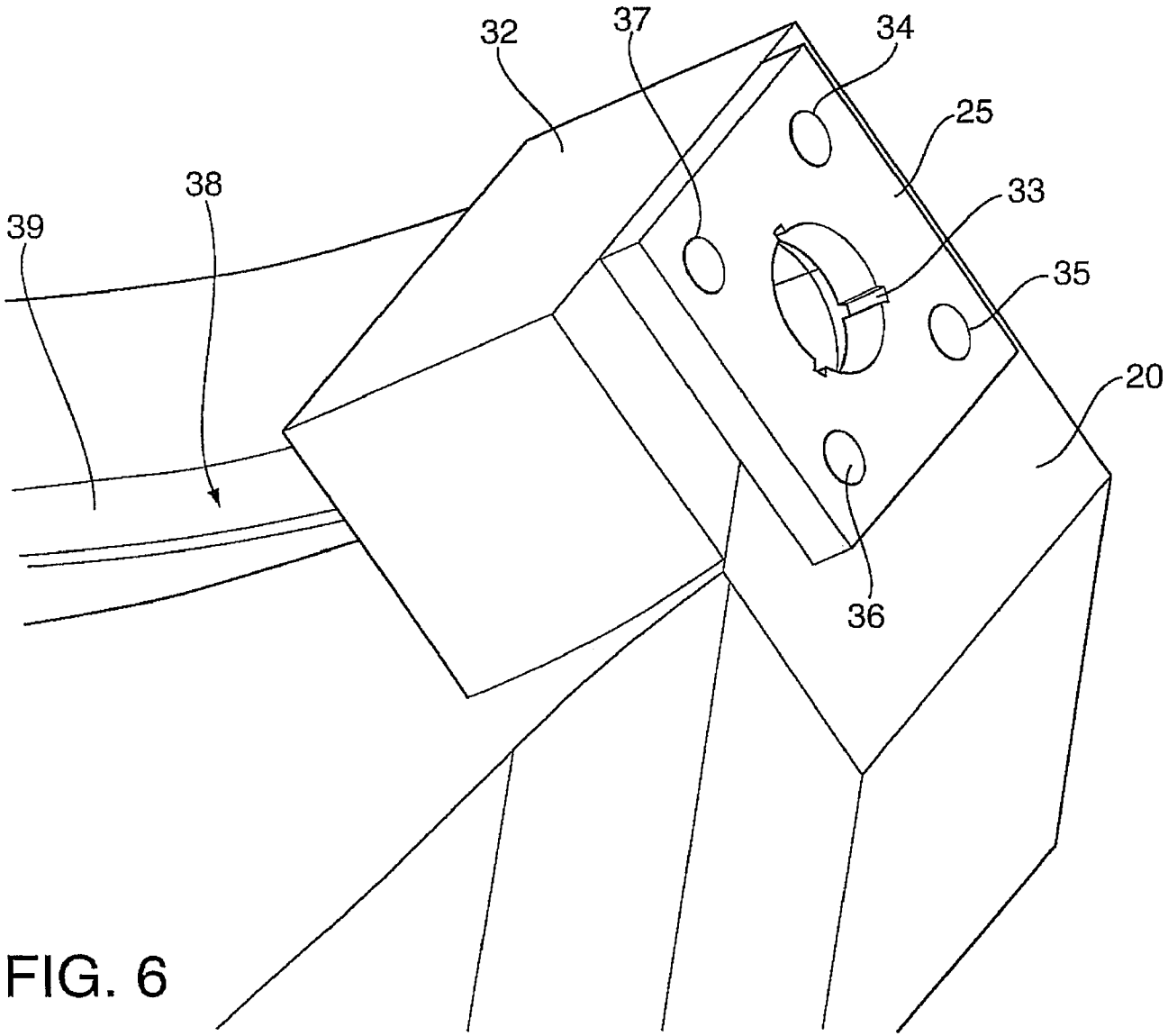
FIG. 6 shows a perspective view of the mold with its connector clamp in position.

In FIG. 6, mold 20 is presented whilst being attached to plate 25 and an upper mold portion 32 which surrounds primarily the connector portion. Connector location plate 25 incorporates a number of indents such as indent 33 allowing the passage of pin 27 of a typical connector. Upper mold portion 32, plate 25 and mold 20 are joined together by screws which may be placed in bores 34, 35, 36 and 37. Threaded tunnels are provided in upper mold portion 32 and mold 30 to ensure a tight connection between the three components.

FIG. 6 also illustrates a trough 38 in which the fiber, resin and wires are placed for hardening. The resulting hardened component incorporates a substantially planar portion with said walls such as wall 39 projecting upwards in the mold.

Figure 7:
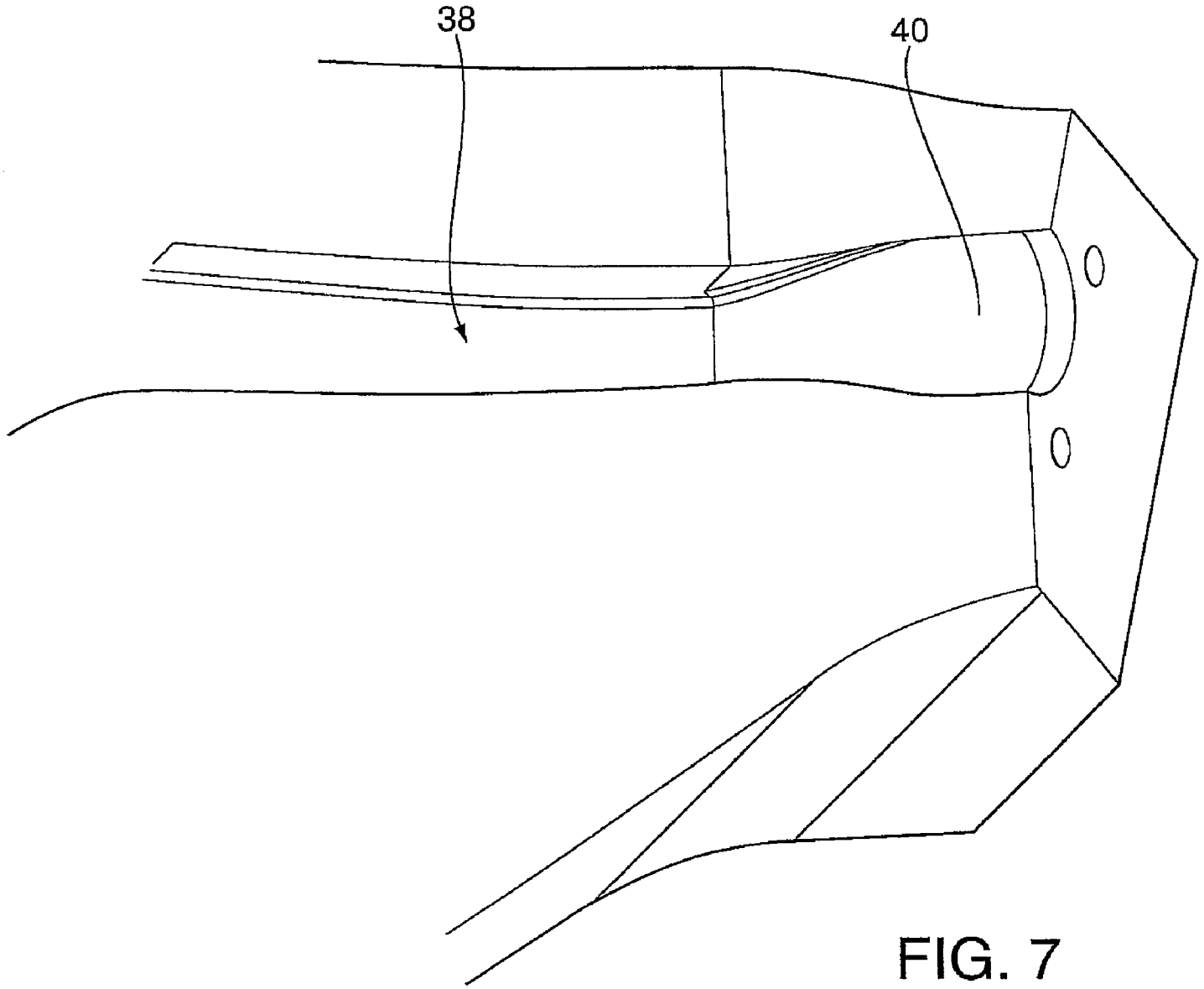
FIG. 7 shows a perspective top view of a portion of the mold without its connector portion in place.

FIG. 7 shows the trough 38 in greater detail. Before the components are placed in the mold it is preferred to use a release agent. Trough 38 widens out towards the connector portion 40.

Figure 8:
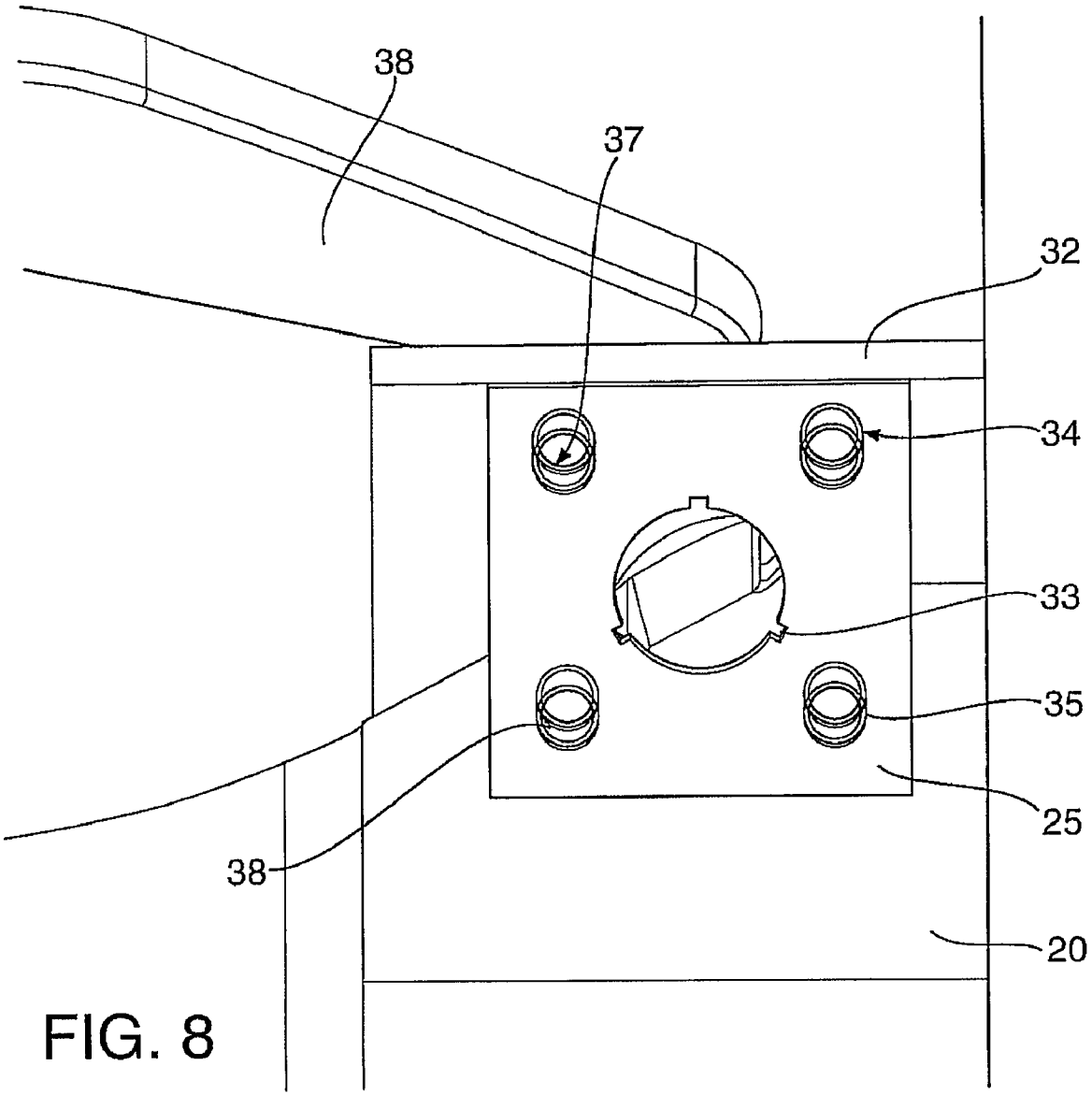
FIG. 8 shows a perspective view from the front where a connector would be located.

FIG. 8 is another view of the mold arrangement of FIG. 6. Identical numerical references are used for clarity.

The resulting component has a smooth and shiny surface and is preferably comfortable at 130 degrees Celsius.

The composite material used may be obtained from Advanced Composite Material for example MTM57 CF0300.

The preferred insulation and conductor kinds are as follows.

For the insulation sheaths, the following are preferred: PTFE; Polyalkene/PVDF dual wall; Polyimide; ETFE, HSTF; FEP; TFE.

With regards to the conductor material types, the following are preferred: Copper; Tin-plated copper; Silver-plated copper; Nickel-plated copper; Silver-plated copper alloy; Nickel-plated copper alloy.

The present invention may be embodied in other specific forms without departing from its spirit or essential characteristics. The described embodiments are to be considered in all resects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A wiring component comprising: an array of multiple wires; at least one connector which engages said wires; at least two layers of a hardened compound of fiber and a filler sandwiching said wires; the areas adjacent to the wires also comprising one of said filler and an additional filler which immobilizes the wires relative to said layers; wherein at least a portion of said connector is embedded in one of said filler and said additional filler; whereby said connector is immobilized relative to said layers.

2. A wiring component according to claim 1, wherein one of said filler and said additional filler is a non-conductive compound.

3. A wiring component according to claim 1, wherein said at least two layers of compound are employed on either side of the multiple wires.

4. A wiring component according to claim 1, wherein the wires each comprise a sheath in addition to said compound which is resistant to 100 degrees Celsius in a vacuum oven.

5. A wiring component according to claim 1, wherein the array is rigid and molded to conform to the shape of a vehicle component.

6. A wiring component according to claim 1, wherein the connector incorporates a cap protecting its connectable portion; wherein said cap incorporates a seal on the inside of said cap.

7. A wiring component according to claim 1, wherein the fibers are woven.

8. A wiring component according to claim 1, wherein the wires comprise copper and at least one sheath creating a bond between the wires and layers.

9. A wiring component according to claim 1, wherein the component incorporates a substantially planar portion and a lip extending from said planar portion, the lip running substantially along at least one edge of the length of the planar portion at an angle.

10. A wiring component comprising: an array of multiple wires; at least two layers of a hardened compound incorporating a fiber and a resin, said hardened compound sandwiching said array; and a filler filling the areas adjacent to the wires; whereby at least one of said filler and said hardened compound immobilizes the wires relative to said layers; wherein the fibers are woven; and the wiring component is a rigid structure; wherein the component incorporates a substantially planar portion and a lip extending from said planar portion, the lip running substantially along at least one edge of the length of the planar portion at an angle.

11. A wiring component according to claim 10, wherein said filler is a non-conductive compound.

12. A wiring component according to claim 10, wherein said at least two layers of compound are employed on either side of the multiple wires.

13. A wiring component according to claim 10, wherein the wires each comprise a sheath in addition to said compound which is resistant to 100 degrees Celsius in a vacuum oven.

14. A wiring component according to claim 10, wherein the wires comprise copper and at least one sheath creating a bond between the wires and layers.

15. A wiring component comprising: an array of multiple wires; at least two layers of a hardened compound incorporating a fiber and a resin, said hardened compound sandwiching said array; and a filler filling the areas adjacent to the wires; whereby at least one of said filler and said hardened compound immobilizes the wires relative to said layers; wherein the wires comprise copper and at least one sheath creating a bond between the wires and layers; wherein the wiring component is a rigid structure; wherein the component incorporates a substantially planar portion and a lip extending from said planar portion, the lip running substantially along at least one edge of the length of the planar portion at an angle.

16. A wiring component according to claim 15, wherein said filler is a non-conductive compound.

17. A wiring component according to claim 15, wherein at least two layers of compound are employed on either side of the multiple wires.

18. A wiring component comprising:

an array of multiple wires; at least two layers of a hardened compound incorporating a fiber and a resin; said hardened compound sandwiching said array; and a filler filling the areas adjacent to the wires; whereby at least one of said filler and said hardened compound immobilizes the wires relative to said layers; wherein the wires comprise copper and at least one sheath creating a bond between the wires and layers; wherein the wiring component is a rigid structure;

wherein said at least one sheath is resistant to 100 degrees Celsius in a vacuum oven.

19. A wiring component according to claim 15, wherein the fibers are woven.

20. A method of producing a wiring component, the method comprising the steps of:

placing a plurality of wires between layers of a hardenable fiber and resin compound;

vacuuming air from the array;

placing the layers and wires on a mold;

heat treating the array in a vacuum oven; and allowing the wiring component to cool into a rigid component.

21. A method according to claim 20, comprising the step of attaching a connector to said wires and clamping said connector to said mold to form a barrier between said compound and the connectable portion of said connector.

22. A wiring component comprising: an array of multiple wires; at least one connector which engages said wires; at least two layers of a hardened fiber and a filler compound sandwiching said wires; the areas adjacent to the wires also comprising said filler compound which immobilizes the wires relative to said layers; wherein at least a portion of said connector is embedded in said filler compound and wherein the connector incorporates a cap protecting its connectable portion; wherein said cap incorporates a seal on the inside of said cap.

23. A wiring component according to claim 22, wherein said filler is a non-conductive compound.

24. A wiring component according to claim 22, wherein said at least two layers of compound are employed on either side of the multiple wires.

25. A wiring component according to claim 22, wherein the wires each comprise a sheath in addition to said compound which is resistant to 100 degrees Celsius in a vacuum oven.

26. A wiring component according to claim 22, wherein the array is rigid and moulded to conform to the shape of a vehicle component.

27. A wiring component according to claim 22, wherein the fibers are woven.

28. A wiring component according to claim 22, wherein the wires comprise copper and at least on sheath creating a bond between the wires and layers.

29. A wiring component according to claim 22, wherein the component incorporates a substantially planar portion and a lip running substantially along at least one edge of the length of the planar portion and extending from said planar portion at an angle.

* * * * *